US012091826B2

(12) United States Patent
Buschmann et al.

(10) Patent No.: US 12,091,826 B2
(45) Date of Patent: Sep. 17, 2024

(54) ROAD FINISHING MACHINE WITH TRANSVERSE PROFILE CONTROL

(71) Applicant: JOSEPH VOEGELE AG, Ludwigshafen/Rhein (DE)

(72) Inventors: Martin Buschmann, Neustadt (DE); Ralf Weiser, Ladenburg (DE)

(73) Assignee: Joseph Voegele AG, Ludwigshafen/Rhein (DE)

( * ) Notice: Subject to any disclaimer, the term of this patent is extended or adjusted under 35 U.S.C. 154(b) by 156 days.

(21) Appl. No.: 17/225,316

(22) Filed: Apr. 8, 2021

(65) Prior Publication Data

US 2021/0317620 A1 Oct. 14, 2021

(30) Foreign Application Priority Data

Apr. 8, 2020 (EP) ..... 20168635

(51) Int. Cl.
*E01C 19/26* (2006.01)
*E01C 19/48* (2006.01)
*E01C 23/01* (2006.01)

(52) U.S. Cl.
CPC ..... *E01C 19/268* (2013.01); *E01C 19/4873* (2013.01); *E01C 23/01* (2013.01)

(58) Field of Classification Search
CPC . E01C 19/268; E01C 19/4873; E01C 2301/01
(Continued)

(56) References Cited

U.S. PATENT DOCUMENTS 5,549,412 A * 8/1996 Malone ..... E01C 19/004 404/84.2
6,799,922 B2 10/2004 Smith
(Continued)

FOREIGN PATENT DOCUMENTS

CN 1764757 A 4/2006
CN 202787036 U 3/2013
(Continued)

OTHER PUBLICATIONS

Chinese Search Report (with Partial English Translation), dated May 19, 2022, Application No. 202110376748.1, 4 Pages.
(Continued)

*Primary Examiner* — Raymond W Addie
(74) *Attorney, Agent, or Firm* — Brooks Kushman P.C.

(57) ABSTRACT

A road finishing machine comprises a screed, which includes at least one compacting unit. The road finishing machine furthermore comprises a GNSS receiver, as well as a material conveyor. The road finishing machine furthermore comprises an electronic control system which comprises a memory and a data processor, wherein in the memory, digital construction data, in particular a nominal height profile of a road pavement to be finished, are stored. The control system is configured to automatically control, based on the construction data, an actuator mechanism provided on the road finishing machine, in particular a levelling cylinder and/or a transverse camber adjustment and/or a slope adjustment and/or a berm adjustment, in order to install laying material with the nominal height profile and thereby a defined transverse profile for the respective position coordinate point of the road finishing machine determined with the GNSS receiver.

18 Claims, 4 Drawing Sheets

(58) Field of Classification Search
USPC ..... 404/84.05, 118
See application file for complete search history.

(56) References Cited

U.S. PATENT DOCUMENTS

| | | | | |
|---|---|---|---|---|
| 8,356,957 | B2 | 1/2013 | Weiser | |
| 8,454,266 | B2 | 6/2013 | Buschmann et al. | |
| 8,894,323 | B2 | 11/2014 | Rutz et al. | |
| 9,670,629 | B2 | 6/2017 | Buschmann et al. | |
| 2005/0265785 | A1* | 12/2005 | Kieranen | E01C 19/006 404/84.2 |
| 2006/0198700 | A1 | 9/2006 | Maier et al. | |
| 2009/0317186 | A1 | 12/2009 | Glee et al. | |
| 2017/0205814 | A1* | 7/2017 | Marsolek | G06F 3/04847 |
| 2017/0228108 | A1* | 8/2017 | Marsolek | G07C 5/008 |
| 2018/0340302 | A1 | 11/2018 | Menzenbach et al. | |
| 2020/0032464 | A1* | 1/2020 | O'Donnell | G01S 19/14 |

FOREIGN PATENT DOCUMENTS

| | | | |
|---|---|---|---|
| CN | 204151652 | U | 2/2015 |
| DE | 19951297 | C1 | 4/2001 |
| DE | 102015007647 | A1 | 12/2015 |
| DE | 102017005015 | A1 | 11/2018 |
| EP | 0849399 | A1 | 6/1998 |
| EP | 0 849 399 | B1 | 3/2002 |
| EP | 2366830 | A1 | 9/2011 |
| EP | 2366831 | A1 | 9/2011 |
| EP | 2 514 872 | A1 | 10/2012 |
| EP | 2514872 | B1 | 7/2015 |
| EP | 3208381 | A1 | 8/2017 |
| JP | 2015028240 | A | 2/2015 |
| JP | 2015045276 | A | 3/2015 |
| WO | 2006092441 | A1 | 9/2006 |

OTHER PUBLICATIONS

Chinese Office Action (with English Translation), dated May 25, 2022, Application No. 202110376748.1, 7 Pages.

European Search Report dated Sep. 3, 2020, Application No. 20168635.9-1002, Applicant Joseph Voegele AG, 8 Pages.

Stringless Paving, Tech Brief, U.S. Department of Transportation, Federal Highway Administration, Jan. 2019, FHWA-HIF-18-011 (12 pages).

Leica PaveSmart 3D for Asphalt Pavers, User Manual, Leica Geosystems AG, Heerbrugg, Switzerland (140 pages).

Asphalt im Strassen-bau, 2. Auflage, Jurgen Hutschenreuther, Thomas Worner, Kirschbaum (with English machine translation (4 pages).

Opposition to a European Patent, Patent No. 3892777 (Application No. 20168635.9), Applicant: Joseph Voegele AG, Notice dated Jun. 5, 2024 (with English machine translation) (46 pages).

Leica iCON pave for asphalt paving, Leica Geosystems (Published: Jan. 2020) (D10), screen shots of video (with English machine translations of comments) retrieved from https://www.youtube.com/watch?v=xCVT2_F8Ndo&list=PL0td7rOVk_IWcmYg-PJFsAKJ5CK0Rlzh8h&index=41, and related document downloaded from European Patent Office, European Patent Register, EP 3892777 B1, May 30, 2024 Notice of Opposition, Citation in opposition procedure—010 (11 pages).

MOBA 3D MATIC (Published: Nov. 2019) (D11), document downloaded from European Patent Office, European Patent Register, EP 3892777 B1, May 30, 2024 Notice of Opposition, Citation in opposition procedure—011 (with partial English machine translation retrieved from https://moba-automation.de/produkte/3d-nivellierung) (16 pages).

3dconstruction (Topcon) (Published: Mar. 2019) (D12), document downloaded from European Patent Office, European Patent Register, EP 3892777 B1, May 30, 2024 Notice of Opposition, Citation in oppostion procedure—012 (with English machine translation of pp. 14 and 26) (34 pages), apparently related to the following website https://www.topconsolutions.com/product-group/construction-field/3043-3d-mc-asphalt.

Road News (Joseph Vögele AG) (Published: Sep. 2010) (D13), document downloaded from European Patent Office, European Patent Register, EP 3892777 B1, May 30, 2024 Notice of Opposition, Citation in opposition procedure—013 (with English machine translation of p. 36) (53 pages).

Leica ICON pave 3D (Published: 2018) (D14), document downloaded from European Patent Office, European Patent Register, EP 3892777 B1, May 30, 2024 Notice of Oppostion, Citation in opposition procedure—014 (50 pages), apparently related to the following website https://leica-geosystems.com/de-de/products/machine-control-systems/pavers-and-cold-planers/leica-icon-pave-asphalt.

* cited by examiner

ROAD FINISHING MACHINE WITH TRANSVERSE PROFILE CONTROL

CROSS-REFERENCE TO RELATED APPLICATIONS

This application claims foreign priority benefits under 35 U.S.C. § 119(a)-(d) to European patent application number EP 20168635.9, filed Apr. 8, 2020, now European patent number EP 3892777 B1, issued Aug. 30, 2023, which is incorporated by reference in its entirety.

TECHNICAL FIELD

The present disclosure relates to a road finishing machine and a method for operating a road finishing machine.

BACKGROUND

Roadway pavements are often constructed not only in a completely horizontal and flat form, but have a transverse profile to achieve advantageous effects, such as an improved draining of rainwater. For example, straight road sections are finished with a transverse camber, i.e., they slope from a highest line in the roadway's centre on both sides to the outside. Curves are made with a superelevation increasing from the inner to the outer curve radius. To be able to install such profiles with a road finishing machine, it has been known up to now to change the side slope of the screed as a whole and incline sections of the screed separately. The adjustments are made by an operator, for example, by means of the hydraulic adjustment of the levelling cylinders, or by manually actuatable adjusting nuts. A partially automatic control is known from EP 0 849 399 B1.

SUMMARY

It is an object of the present disclosure to provide a road finishing machine with an improved control system for the automatic transverse profile control, and an improved method for operating a road finishing machine.

The object is achieved by a road finishing machine according to the disclosure, or by a method for operating a road finishing machine according to the disclosure.

A road finishing machine according to the disclosure comprises a screed, the screed comprising at least one compacting unit. The road finishing machine furthermore comprises a Global Navigation Satellite System (GNSS) receiver, a material conveyor, and an electronic control system which in turn comprises a memory and a data processor. In the memory, digital construction data are stored, in particular a nominal height profile of a road pavement to be finished. The control system is configured to automatically control, based on the construction data, an actuator mechanism provided on the road finishing machine, in particular a levelling cylinder and/or a transverse camber adjustment and/or a slope adjustment and/or a berm adjustment, to install the paving material or laying material with the nominal height profile and thereby a defined transverse profile for the respective position coordinate point of the road finishing machine determined by the GNSS receiver. That means, both the position of the whole screed in the space as well as the orientation of individual screed parts with respect to each other can be adjusted. For example, the side slope of the screed for installing a curve superelevation can be automatically adjusted. Equally, a left and a right screed half can be automatically adjusted in an angled manner with respect to each other to finish a transverse camber. In addition to the main screed, add-on or pull-out elements can be automatically adjusted, in particular, their inclinations transverse to the direction of travel can be automatically adjusted. The actuator mechanism can be, for example, hydraulic or electromotive actuators or drives. That means, the transverse profiles can be exactly planned in the setting up of the digital construction data and subsequently precisely installed with the road finishing machine based on the coordinates. Possible errors by an operator are excluded, and he/she can take care of other operational functions of the road finishing machine.

Preferably, the control system is configured to automatically control the steering system of the road finishing machine depending on the position. It is thus ensured that the road pavement is installed at the exactly provided position, which is in particular important in a profiled roadway surface since the foundation and lateral transitions in the ground are coordinated therewith. By the GNSS-based position measurement of the road finishing machine, other reference systems, such as mechanical, laser-based, or visual monitoring by the operator, can be eliminated, but they still can be also employed additionally. By the automatic control of the steering system, the operator is further relieved.

In an advantageous variant, the control system is configured to automatically adjust the screed's width depending on the position. In this way, changes of the desired width of the roadway pavement are taken into consideration, while the operator is not additionally challenged or can confine himself/herself to monitoring the automatic adjustments. The already mentioned as well as the following automatic functions of the road finishing machine can, based on the digital construction data which are processed by the electronic control system, altogether allow a nearly or completely autonomous laying of a road pavement.

Preferably, the screed comprises a side slope sensor, the control system being configured to automatically control the actuator mechanism based on the data received from the side slope sensor. The screed can comprise a plurality of side slope sensors, at least one of which is suitably attached on each of the slope-adjustable screed part. For example, the side slope of a right and a left half of the basic screed, of a right and a left add-on or pull-out part, and optionally of elements for the berm adjustment can be measured at the add-on or pull-out parts. For example, the control system can automatically and exactly perform the desired adjustments by means of this feedback mechanism. The data of the side slope sensors can indicate the absolute side slope of the respective screed part in the space and/or the relative slope to one or more other screed parts.

Suitably, the road finishing machine comprises a sensor for measuring an actual height profile, wherein the control system is configured to calculate a deviation of the actual height profile from the nominal height profile and automatically control the actuator mechanism in response thereto. In this way, with a feedback mechanism, the automatic installation activity is mechanically controlled, and the settings can be automatically readjusted to achieve the desired result. That means, not only the machine settings, as mentioned in the preceding paragraph, but also the actual installation result can be monitored, thereby achieving a particularly high installation quality.

In an advantageous variant, the control system is configured to automatically adjust the actuator mechanism in the transition between two transverse profiles. Such transitions, for example of a transverse camber on a straight roadway section to a curve superelevation, are particularly complicated to establish manually since the angling of two screed parts with respect to each other has to continuously pass over into a side slope of an otherwise straight screed without any unevenness occurring. In particular in curve regions, a high roadway quality is important. The automatic adjustment accomplishes this installation with utmost quality and eliminates adjustment errors which are possible in the manual control. The GNSS position measurement of the road finishing machine here ensures the exact positioning of the roadway profiles and their transitions. Side slope sensors, for example each for a left and a right screed half, can monitor the current setting of the screed. That means, the operator does not have to initiate the transition sequence manually by means of a position measurement made by him/her.

Ideally, the control system is configured to compare the actuator settings required for the installation of the nominal height profile with their setting limits. In this way, it is ensured that the employed road finishing machine can install the desired profiles. Here, it is conceivable to perform this check also by means of an external data processing equipment. In both cases, the data of the road finishing machine have to be stored digitally for this.

In a further variant, the control system is configured to compare the adjustment speeds of the actuators required for installing the nominal height profile with the possible adjustment speeds. This in particular permits to exactly plan the installation of changes in the transverse profile and correspondingly adapt the travel or installation speed of the road finishing machine.

A method according to the disclosure for operating a road finishing machine, in particular a road finishing machine according to one of the preceding embodiments, comprises the following procedure steps:

storing digital construction data, in particular a nominal height profile and a transverse profile of a road pavement to be finished defined therewith, in a memory of an electronic control system of the road finishing machine, installing a paving material or laying material by means of a screed of the road finishing machine, wherein the respective current position of the road finishing machine is determined by means of a GNSS receiver and, with reference to the nominal height profile, an actuator mechanism provided on the road finishing machine, in particular a levelling cylinder and/or a transverse camber adjustment and/or a slope adjustment and/or a berm adjustment, is automatically controlled.

In this way, the road pavement is installed with the desired geometry and at the provided position. Here, the position of the GNSS receiver or the receiving antenna at the road finishing machine can be taken into consideration, so that the position of the screed is exactly referenced. To this end, two GNSS receivers can also be employed.

Suitably, a side slope of the screed and/or a screed part is determined by means of one or more side slope sensors. Ideally, the side slope of each adjustable screed part, such as the left or right half of the screed, pull-out elements, berm elements, if present, is measured by means of a separate sensor at the respective element. The data are received and processed by the control system, so that an automatic feedback mechanism monitors the exact adjustment of the side slope. Equally, the data can be displayed to an operator.

Preferably, an actual height profile of the installed road pavement is determined by means of a sensor. These data can be shown, for example, to the operator on a display device. In this way, the operator can also manually intervene in the finishing process, if required, and make corrections.

In an advantageous variant, a difference of the actual height profile relative to the nominal height profile is calculated, and the actuator mechanism is automatically controlled by closed-loop control to minimise the difference. By this feedback mechanism, a particularly high finishing quality is achieved.

Preferably, the actuator mechanism is automatically adjusted in the transition between two transverse profiles. The adjustments of the screed have to be continuously changed in the transition of two transverse profiles until the transition is completed. Manually, this is extremely difficult and prone to errors. Moreover, a second operator is often required. By the automatic closed-loop control, the pavement is installed with a constant high quality, and the operator is relieved.

Suitably, the digital construction data are transmitted, at the beginning of the process, from an external data processing equipment into the memory of the electronic control system by means of a radio or cable connection. In this way, all previous calculations and data additions can be performed at a PC. For example, the data of the nominal height profile of the road pavement can be linked with the three-dimensional height profile of the foundation or calculated based thereon, respectively. The foundation data can have been obtained previously by a surface scan. For example, the layer thickness of the laying material, the material demand, and other additional data can also be calculated. Here, however, it is also conceivable to perform such calculations by means of the control system of the road finishing machine itself. The external processing of the data, however, is often more practicable, and one can possibly do without display and input equipment on the road finishing machine which would otherwise be required.

In a preferred variant, before the beginning of the installation, the actuator settings required for the installation of the nominal height profile are compared with their setting limits. In this way, it is ensured that the road finishing machine and in particular the screed is suited for finishing the road pavement with the desired transverse profiles.

In a further advantageous variant, before the beginning of the installation, the required adjustment speeds of the actuators are compared with the possible adjustment speeds. The installation speed can be correspondingly planned and adjusted.

BRIEF DESCRIPTION OF THE DRAWINGS

In the following, exemplified embodiments of the disclosure are described more in detail with reference to the figures.

Corresponding components are always provided with the same reference numerals in the figures.

DETAILED DESCRIPTION

Figure 1:
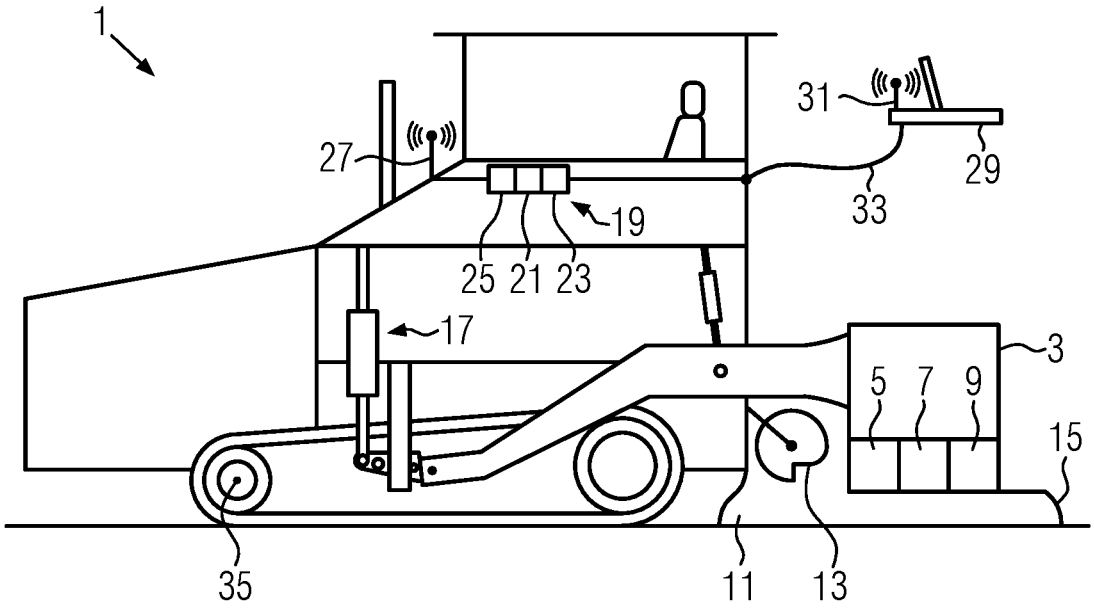
FIG. 1 shows a side view of a road finishing machine.

FIG. 1 shows a road finishing machine 1 with a screed 3 with a tamper 5, a screed plate 7, and a pressing strip 9 for compacting paving material or laying material 11 which is placed in front of the screed 3 by means of a material conveyor 13. The screed 3 finishes a road pavement 15 with a predetermined transverse profile. In this side view, a levelling cylinder 17 can furthermore be seen which can be controlled, among other things, for adjusting a side slope of the screed 3. To this end, a control system 19, which comprises a memory 21 and a data processor 23, is connected in a suitable manner with the levelling cylinder 17 or a hydraulic control connected thereto. The road finishing machine 1 furthermore comprises a GNSS receiver 25 for determining the current position coordinate, wherein a distance of the actual receiving antenna 27 to the screed 3 can be considered to determine the actual position of the screed 3. As an alternative, the GNSS receiving antenna 27 can also be arranged on the screed 3. Moreover, two GNSS receiving antennae 27 can be used to exactly determine the position of the screed 3. An external data processing equipment 29 can exchange data with the control system 19 by means of a radio connection 31 or a cable connection 33. At least one axle of the road finishing machine 1 is equipped with a steering system 35 which can also be controllable by the control system 19.

Figure 2:
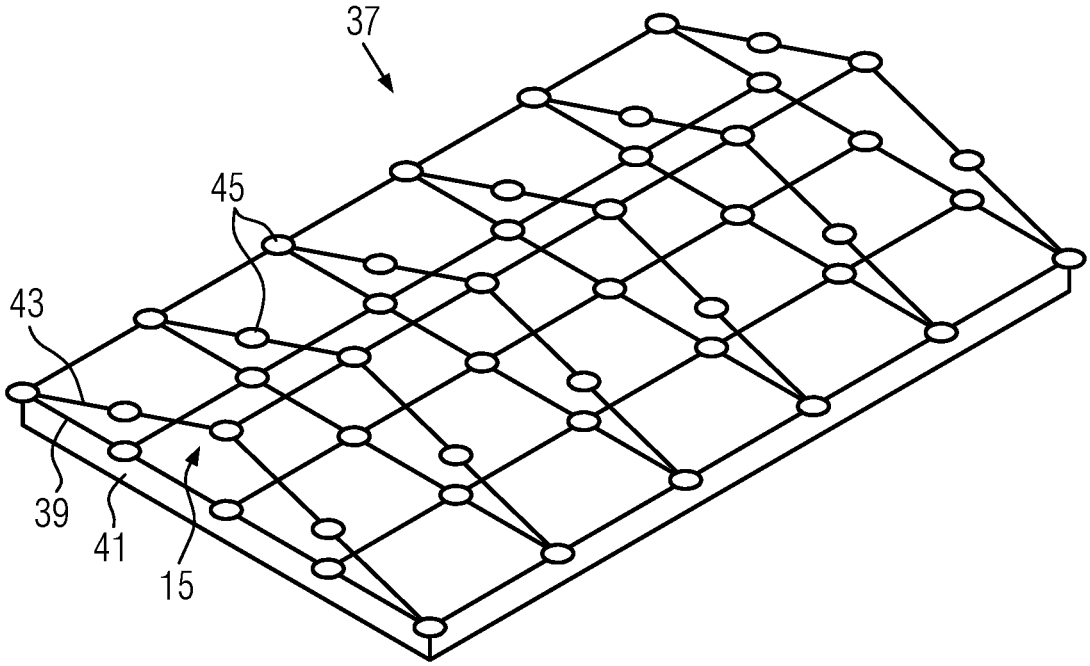
FIG. 2 shows a schematic view of digital construction data.

FIG. 2 shows a schematic representation of digital construction data 37 which in this example comprise a height profile 39 of a foundation 41 as well as a nominal height profile 43 of the road pavement 15 to be finished. The nominal height profile 43 is or defines the transverse profile and is here represented in the form of a transverse camber. The construction data 37 are each stored for position coordinate points 45 and represent, together with the height data, a three-dimensional data record. The transverse profile setting of the screed 3 is adjusted based on the construction data 37 for the respective position coordinate point 45 detected with the GNSS receiver 25. It will be appreciated that transitions between two types of profiles are suitably designed gradually, that means without abrupt changes. The foundation data 39 can be obtained, for example, by a surface scan. To this end, for example, a vehicle drives along the foundation, a surface scanner and a GNSS receiver being arranged at the vehicle and the height data 39 being stored with the respective position coordinate.

Figure 3:
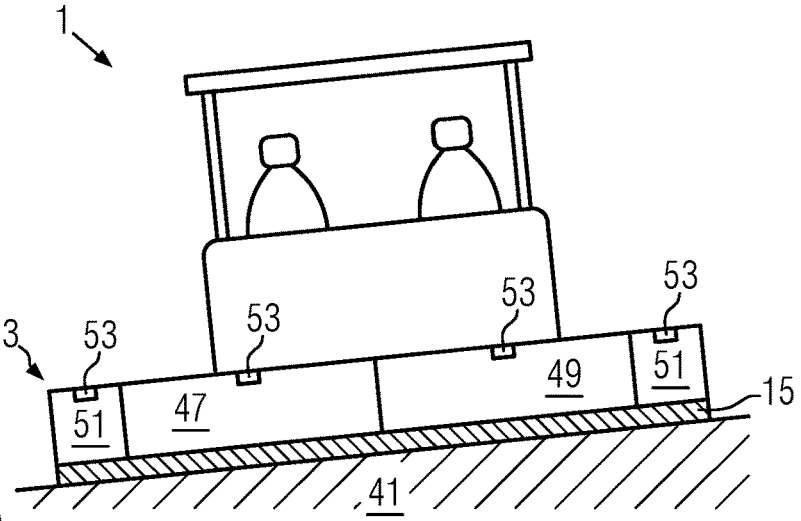
FIG. 3 shows a rear view of a road finishing machine with a screed in a side slope.

FIG. 3 shows a rear view of a road finishing machine 1 with the screed 3 in a side slope for finishing an oblique roadway surface, as it is used, for example, as a curve superelevation. In the variant represented here, the foundation 41 already has the desired side slope compared to the horizontal. Thus, the road finishing machine 1 is already driving in an inclined way on the foundation 41, wherein the screed 3 is, with its right-left axis, essentially perpendicular to the remaining road finishing machine 1. It is, however, equally possible to bring the screed 3 into a side slope relative to the chassis of the road finishing machine 1 and to the foundation, in case of a horizontal foundation 41, in order to finish a road pavement 15 with a side-sloped roadway surface on the horizontal foundation 41. The side slope of the complete screed 3 is here performed by the adjustment of the levelling cylinders 17. For all embodiments, the screed 3 can comprise a left screed half 47, a right screed half 49, as well as broadening and/or pull-out parts 51. To monitor the side slope, side slope sensors 53 can be arranged at the screed 3 or at the respective screed parts 47, 49, 51.

Figure 4:
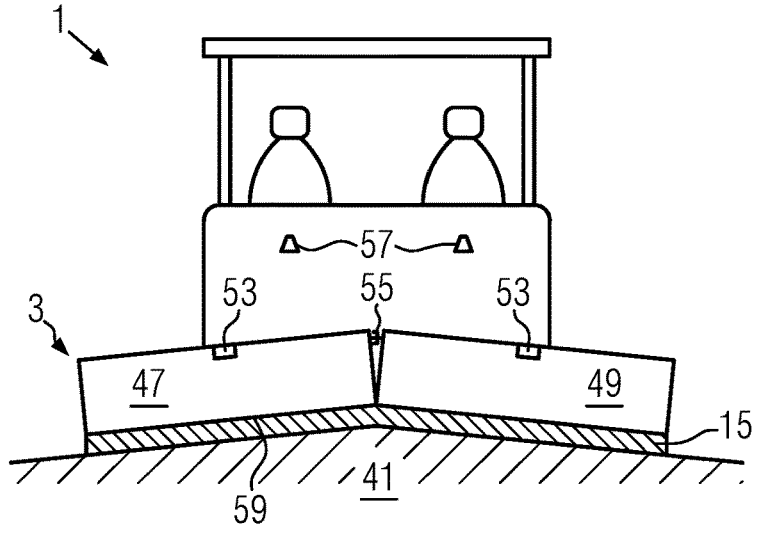
FIG. 4 shows a rear view of a road finishing machine with a screed in a transverse camber position.

FIG. 4 shows a rear view of a road finishing machine 1 with the screed 3 in a transverse camber position. A left screed half 47 and a right screed half 49 are adjusted to a mutually inclined position by means of an actuator for the transverse camber adjustment 55. Here, a positive transverse camber is shown in which the outer ends of the screed 3 are inclined downwards. Equally, a negative transverse camber is possible wherein the outer ends face upwards. In this example, a screed 3 without pull-out parts 51 is shown, while the pull-out parts 51 could be provided.

Moreover, sensors 57 for measuring the actual height profile 59 of the installed road pavement 15 are shown. The measuring data are compared with the nominal height profile 43 by the control system 19, and the actuator or actuators is/are correspondingly readjusted for the transverse camber adjustment 55 to avoid deviations. With the actuators 55 for the transverse camber adjustment, the geometry of the screed 3 can be adjusted. In addition, by means of the levelling cylinders 17, the side slope of the whole screed 3 and the installation thickness of the road pavement 15 can be adjusted.

Figure 5:
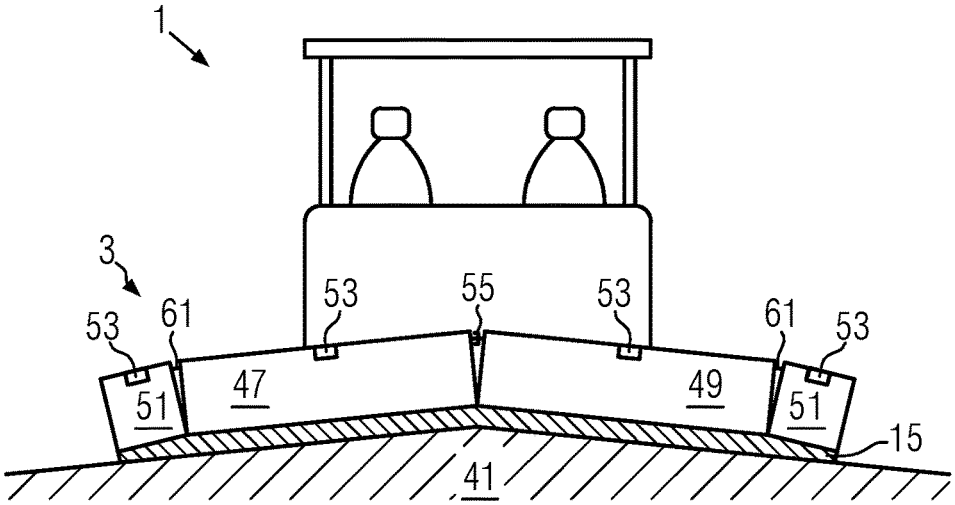
FIG. 5 shows a rear view of a road finishing machine with a screed in a slope position.

FIG. 5 shows a rear view of a road finishing machine 1 with the screed 3 in a slope position. Here, the pull-out parts 51 are inclined, in addition to the halves 47, 49 of the basic screed. The adjustments are performed with corresponding actuators for the slope adjustment 61. For example, rain drainages having a more distinct slope at the verges of a roadway can be finished.

Figure 6:
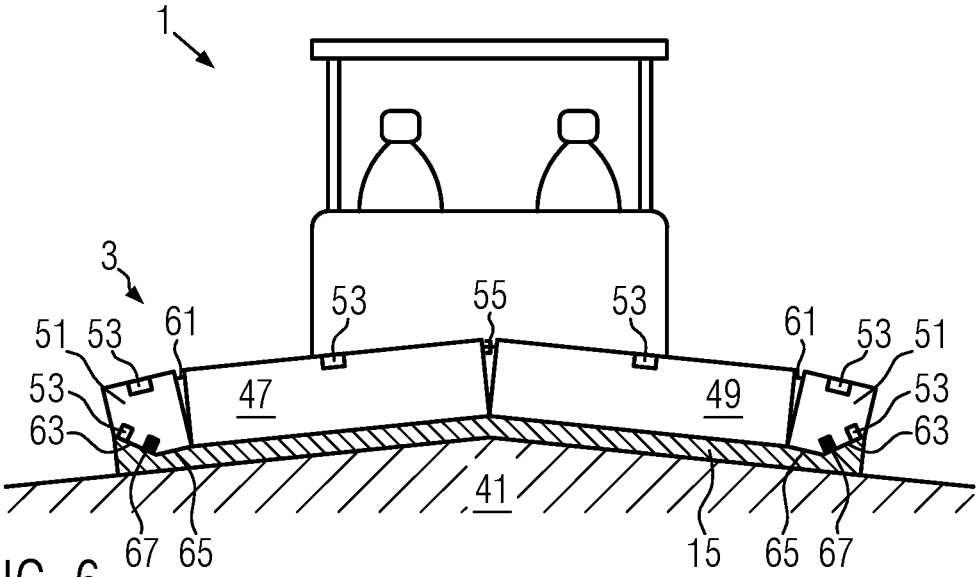
FIG. 6 shows a rear view of a road finishing machine with a screed in a berm position.

FIG. 6 shows a rear view of a road finishing machine 1 with a screed 3 in a berm position. Here, sections 63 of the pull-out parts 51 can be brought into the shown angled position. These berm sections 63 permit, for example, the finishing of a duct for the water drainage at the lateral verge. The berm sections 63 are automatically controllable by the control system 19 by means of actuators for the berm adjustment 67 and can comprise further side slope sensors 53, so that both the side slope of the main surface 65 of the pull-out part and the side slope of the berm section 63 can be measured.

Figure 7:
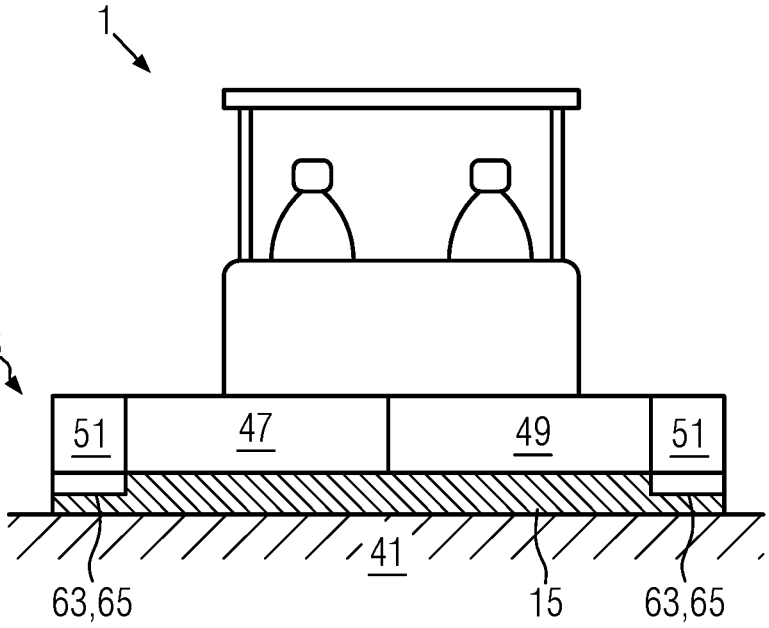
FIG. 7 shows a rear view of a road finishing machine with a screed with height-adjusted pull-out parts.

FIG. 7 shows a rear view of a road finishing machine 1 with a screed 3 with pull-out parts 51 whose lower surfaces, comprising the main surface 65 and, if present, the berm section 63, are height adjustable. This can be done, for example, by hydraulic or electric drives and in addition to the slope adjustment.

Starting from above-shown embodiments of a road finishing machine 1 and a method for operating a road finishing machine 1, numerous variations thereof are conceivable. For example, transverse M- or W-profiles can be adjusted by combinations of the side slopes of this screed parts 47, 49, 51.

What is claimed is:

1. A road finishing machine comprising:

a screed including at least one compacting unit;

a GNSS receiver;

a material conveyor;

an actuator mechanism including a levelling cylinder and/or a transverse camber adjustment and/or a slope adjustment and/or a berm adjustment; and an electronic control system which comprises a memory and a data processor, wherein in the memory, digital construction data, including a nominal height profile of a road pavement to be finished, are storable, and the control system is configured to automatically control, based on the construction data, the actuator mechanism to install paving material with the nominal height profile and thereby a defined transverse profile for a respective position of the road finishing machine determined with the GNSS receiver;

wherein the control system is configured to compare adjustment speeds of actuators of the actuator mechanism required for installation of the nominal height profile with possible adjustment speeds.

2. The road finishing machine according to claim 1, wherein the control system is configured to automatically control a steering system of the road finishing machine depending on the position.

3. The road finishing machine according to claim 1, wherein the control system is configured to automatically adjust a width of the screed depending on the position.

4. The road finishing machine according to claim 1, wherein the screed comprises a side slope sensor, and wherein the control system is configured to automatically control the actuator mechanism based on data received from the side slope sensor.

5. The road finishing machine according to claim 1 further comprising a sensor for measuring an actual height profile, wherein the control system is configured to calculate a deviation of the actual height profile from the nominal height profile, and to automatically control the actuator mechanism in response thereto.

6. The road finishing machine according to claim 1, wherein the control system is configured to automatically adjust the actuator mechanism in transition between two transverse profiles.

7. The road finishing machine according to claim 1, wherein the control system is configured to compare actuator settings required for installation of the nominal height profile with actuator setting limits of the actuator mechanism.

8. The road finishing machine according to 1, wherein the digital construction data, including the nominal height profile, are stored in the memory of the control system.

9. A method for operating a road finishing machine, the method comprising:

storing digital construction data, including a nominal height profile of a road pavement to be finished, in a memory of an electronic control system of the road finishing machine, wherein the nominal height profile comprises a three dimensional data record that defines a transverse profile of the road pavement to be finished; and installing a paving material by a screed of the road finishing machine, wherein a respective current position of the road finishing machine is determined by a GNSS receiver and, with reference to the nominal height profile, an actuator mechanism of the road finishing machine is automatically controlled;

wherein, before a beginning of the installation, required adjustment speeds of actuators of the actuator mechanism are compared with possible adjustment speeds.

10. The method according to claim 9, wherein the actuator mechanism comprises a levelling cylinder and/or a transverse camber adjustment and/or a slope adjustment and/or a berm adjustment.

11. The method according to claim 9, wherein a side slope of the screed and/or a screed part is determined by means of one or several side slope sensors.

12. The method according to claim 9, wherein an actual height profile of the installed road pavement is determined by means of a sensor, and a difference between the actual height profile and the nominal height profile is calculated and the actuator mechanism is automatically controlled to minimize the difference.

13. The method according to claim 9, wherein the actuator mechanism is automatically adjusted in transition between two transverse profiles.

14. The method according to claim 9, wherein the digital construction data are transmitted from an external data processing equipment into the memory of the electronic control system by means of a radio or cable connection.

15. The method according to claim 9, wherein, before a beginning of the installation, actuator settings required for the installation of the nominal height profile are compared with actuator setting limits of the actuator mechanism.

16. A road finishing machine comprising:

a screed including at least one compacting unit;

an actuator mechanism associated with the screed;

a GNSS receiver; and an electronic control system including a memory and a data processor, wherein in the memory, digital construction data, including a nominal height profile of a road pavement to be finished, are stored, and the control system is configured to automatically control, based on the construction data, the actuator mechanism to install paving material with the nominal height profile and thereby a defined transverse profile for a respective position of the road finishing machine determined with the GNSS receiver;

wherein the nominal height profile comprises a three dimensional data record that defines the defined transverse profile, wherein the control system is configured to automatically control a steering system of the road finishing machine depending on the position of the road finishing machine as determined with the GNSS receiver and wherein the control system is configured to compare adjustment speeds of actuators of the actuator mechanism required for installation of the nominal height profile with possible adjustment speeds.

17. The road finishing machine according to 16, wherein the actuator mechanism comprises a levelling cylinder, a transverse camber adjustment, a slope adjustment, or a berm adjustment.

18. The road finishing machine according to claim 16, wherein the control system is configured to automatically adjust, based on the construction data, the actuator mechanism in transition between two different transverse profiles, wherein one of the transverse profiles comprises a straight roadway section, and the other transverse profile comprises a curve superelevation.

* * * * *